US007905747B2

(12) United States Patent
Suzuki et al.

(10) Patent No.: US 7,905,747 B2
(45) Date of Patent: Mar. 15, 2011

(54) FPC JOINING CONNECTOR

(75) Inventors: Teruhito Suzuki, Kouza (JP); Hideyuki Hirata, Yamato (JP); Cong Li, Dalian (CN)

(73) Assignee: Molex Incorporated, Lisle, IL (US)

( * ) Notice: Subject to any disclaimer, the term of this patent is extended or adjusted under 35 U.S.C. 154(b) by 9 days.

(21) Appl. No.: 12/225,212

(22) PCT Filed: Mar. 16, 2007

(86) PCT No.: PCT/US2007/006675

§ 371 (c)(1),
(2), (4) Date: Aug. 25, 2009

(87) PCT Pub. No.: WO2007/120419

PCT Pub. Date: Oct. 25, 2007

(65) Prior Publication Data

US 2010/0151716 A1 Jun. 17, 2010

(30) Foreign Application Priority Data

Mar. 16, 2006 (JP) ..... 2006-072096

(51) Int. Cl.
*H01R 12/24* (2006.01)

(52) U.S. Cl. ..... 439/498; 439/260

(58) Field of Classification Search ..... 439/260, 439/495, 498

See application file for complete search history.

(56) References Cited

U.S. PATENT DOCUMENTS

| | | | | |
|---|---|---|---|---|
| 5,174,782 | A * | 12/1992 | Bogiel et al. | 439/404 |
| 5,482,473 | A * | 1/1996 | Lord et al. | 439/67 |
| 5,501,610 | A * | 3/1996 | Ikemoto | 439/498 |
| 6,364,695 | B1 * | 4/2002 | Watanabe | 439/498 |
| 2010/0068938 | A1 * | 3/2010 | Suzuki et al. | 439/638 |
| 2010/0151716 | A1 * | 6/2010 | Suzuki et al. | 439/260 |

FOREIGN PATENT DOCUMENTS

| | | |
|---|---|---|
| DE | 201 13 287 | 1/2002 |
| JP | 10189185 | 7/1998 |

OTHER PUBLICATIONS

International Search Report for PCT/US07/006675, Jan. 8, 2007.

* cited by examiner

*Primary Examiner* — James Harvey
(74) *Attorney, Agent, or Firm* — Timothy M. Morella

(57) ABSTRACT

A relay connector (10) for joining together two lengths of flat printed circuitry or flat flexible cable is formed from two connector housings (31) of identical shape. The two housings are joined together by a set of conductive terminals (41) and housing engagement members. The terminals are bilaterally symmetrical and have contact and engagement portions at their ends which are received in terminal-receiving grooves in the rear of the two housings. A pair of actuators (11) are rotatably mounted to the housings and they move in opposite directions to open and close.

10 Claims, 11 Drawing Sheets

(a)

(b)

(c)

(a)

(b)

FPC JOINING CONNECTOR

BACKGROUND OF THE INVENTION

The present invention relates generally to a joining connector for providing connection between flat printed circuit cables.

Conventionally, there are "relay" connectors that permit connection between two flat cables, often referred to as a flexible printed circuit (FPC) or a flexible flat cable (FFC), this is shown in Japanese Patent Application Laid-open (kokai) No. 9-185977). FIG. 16 is an exploded view of a conventional relay connector.

As shown in FIG. 16, the relay connector has an insulative housing 301 and a plurality of conductive terminals 302, and are held by the housing 301. The terminals 302 are respectively provided with fixing parts 304 that are press-fit into holes of the housing 301. Each terminal 302 has contact parts 303 in the shape of a cantilever that extend in opposite directions so that flat cables 306 may be inserted into the mouth of both contact parts 303.

Pressure receiving parts 307 extend upward and are connected to the terminals near the bases of the contact parts 303. A pressure shaft 311 is connected to the lower end of a lock lever 310 and is inserted into space between the two pressure 307. The lock lever 310 is rotatably mounted on the housing 301, and is rotated 90 degrees about the shaft 311. The shaft 311 is of substantially rectangular cross section, and a longitudinal axis of the rectangle extends vertically as viewed in FIG. 16.

As illustrated in FIG. 16, the lock lever 310 stands upright to allow the flat cables 306 to be inserted from two sides into the contact parts 303. After inserting the two flat cables 306, the lock lever 310 is rotated 90 degrees counterclockwise, so that the right and left pressure receiving parts 307 are forced apart from one another by the pressure shaft 311. The tips of the contact parts 303 move downward to pinch and lock the flat cables 306 from above, and they contact the leads of the flat cables 306 to electrically connect the right and left flat cables 306.

Such a conventional relay connector has a complicated configuration because the terminals 302 and bilaterally symmetrical and are securely mounted on the single housing 301, with the flat cables 306 inserted from the sides. Therefore, the structure of a mold for forming the housing 301 must be complicated and increases the manufacturing cost. The right and left contact parts 303 are operated simultaneously by the single lock lever 310, so it is necessary to simultaneously insert the right and left flat cables 306. It is not easy to insert the flat cables 306 in the proper attitudes at the same time, which affects the connecting reliability. Furthermore, the connector cannot be carried and moved to a place where the other flat cable 306 is prepared for connection. This lowers the degree of freedom of the operation for connecting the flat cables 306, resulting in lowering of the operability.

SUMMARY OF THE INVENTION

It is therefore a general object of the present invention to solve the above-mentioned problem encountered by the conventional relay connector. This is accomplished by providing a joining or relay connector configured to have a pair of housings, a pair of actuators, and terminals all of a common design, while allowing each actuator to be operated independently. The structures of respective components is simple, the manufacturing of the respective parts and components is simplified, and the assembly of the parts and components is made easy so as to achieve a high mass producability while permitting individual connections of flat cables to ensure a high operability of connecting operation.

To this end, a joining or relay connector according to the present invention includes: (i) a pair of housings each having an insertion opening formed therein; (ii) terminals that are commonly loaded into the housings; and, (iii) a pair of actuators secured to the housings that are movable between a first position that permits insertion of a flat cable and a second position that presses the flat cable against the terminal contacts. Such a connector permits the housings to be connected to each other so that the insertion openings are opposite each other and the contact portions are interconnected with each other.

In a relay connector according to one embodiment of the present invention, the respective housings have the same structure, and the respective actuators have the same structure.

In a relay connector of the present invention, the terminals are bilaterally symmetrical around a center line.

In a relay connector of the present invention, the housings are at least partially connected together by the terminals.

In a relay connector of the present invention, the housings are at least partially connected to each other by connecting members.

In a relay connector of the present invention, each housing is provided with a projecting connecting member formed on a side thereof opposite to the insertion opening, as well as a recess part that receives the connecting member therein. The connecting member and recess part are disposed outwardly to the sides of the array of terminals arranged in the housing.

In a relay connector of the present invention, each housing is provided with an engaging part formed on a side opposite to the insertion opening, and the connecting member is provided with an engagement part in the form of a hook for engaging the opposing housing recess.

In a relay connector of the present invention, the respective actuators are independently movable, and each includes a body part that lies substantially parallel to the inserted flat cable when the actuator is in its second position.

In a relay connector of the present invention, each actuator includes an operation part formed eccentrically in the body part.

In a relay connector of the present invention, a cover member is provided that covers the middle portions of the terminals. This cover member is engaged with the connecting members.

The connectors of the present invention include a pair of the housings, a pair of the actuators, and terminals supported by the housings. The actuators are independent in their movement. Thus, the respective members are simple in structure thereof and easy to manufacture. This leads to easy assembly and easy mass production. The flat cables can be connected independently, increasing the operability of connecting operation.

DESCRIPTION OF THE PREFERRED EMBODIMENTS

Figure 1:
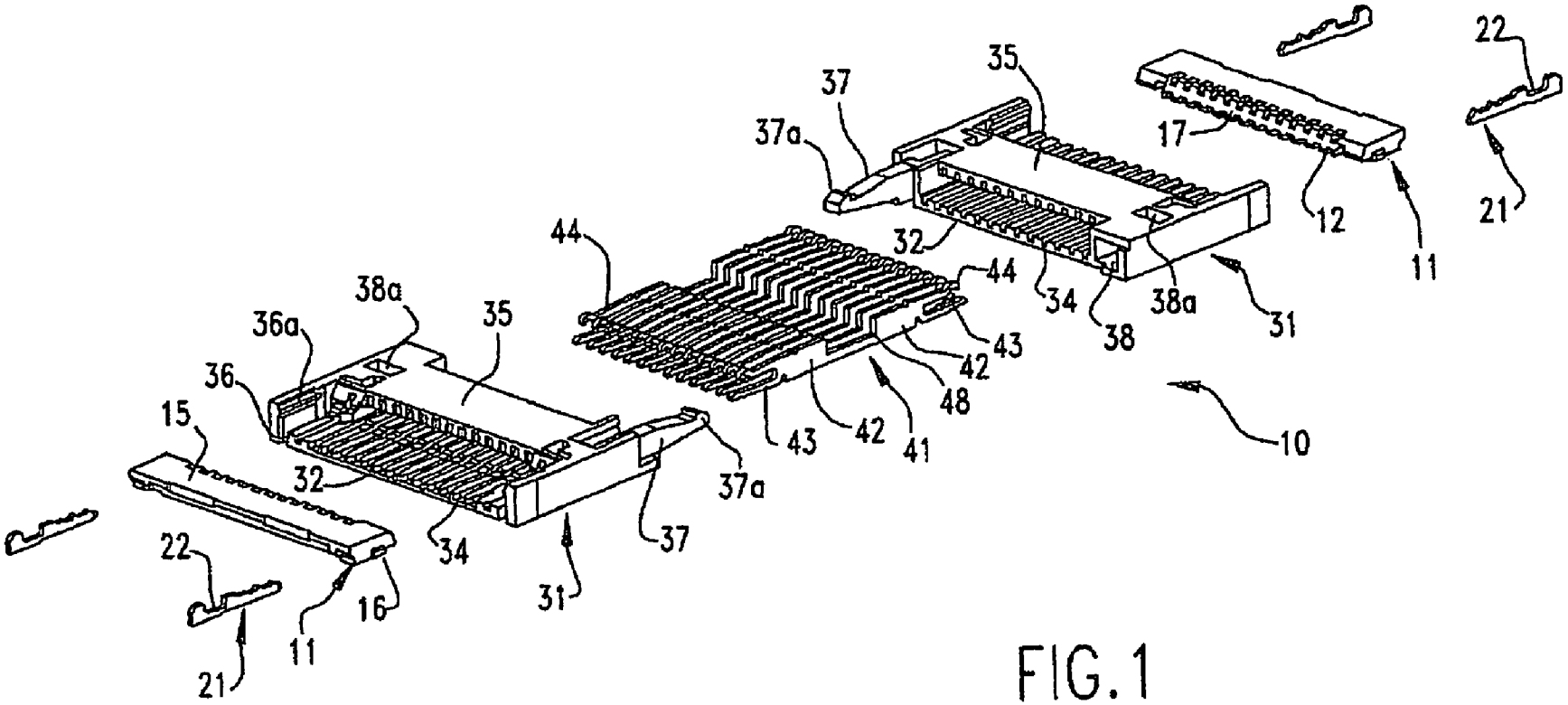
FIG. 1 is an exploded perspective view showing a disassembled state of a connector of the present invention.

Reference numeral 10 designates a relay or joining connector constructed according to the first preferred embodiment, which is used to provide an electrical connection between two flat cables 51 called flexible printed circuits (FPC) or flexible flat cables (FFC), or the like or any type of flat cable provided with conductive leads. The expressions indicating the directions, such as up, down, left, right, front, and rear, which are used to describe the constructions and operations of the parts of the connector 10, are relative rather than absolute.

The connector 10 includes a pair of housings 31, a pair of actuators 11, and common terminals 41. The housings 31 are formed of an insulative material such as synthetic resin, and function as the connector body. The right and left housings 31 are of the same structure and are connected together back-to-back as shown. The actuators 11 are formed of an insulative material and function as a movable member that securely fixes the cables. The actuators 11 are mounted for rotation on the housings 31, respectively. Each actuator 11 is disposed in the housing 31 so that it may move between an opened position as its first position, and a closed position as its second position. The terminals 41 are formed of a conductive material and are provided to be common to both of the housings 31 when assembled, as well held by the housings 31. That is, the respective terminals 41 have bilaterally symmetrical configuration, with right and left portions thereof being disposed in the right and left housings 31.

Each housing 31 is formed in a shape of a thin rectangular box, and has a lower part 32, an upper part 35, and an insertion opening 33, through which the end of the flat cable 51 is inserted from front. The opening is located between the lower part 32 and the upper part 35. The insertion opening 33 includes a plurality of terminal receiving grooves 34, into which the terminals 41 are located. For example, thirteen terminal receiving grooves 34 are formed at a pitch of about 0.5 [mm]. The number and the pitch of the terminal receiving grooves 34 may be suitably changed. Some of the terminals 41 may be omitted as required depending upon the array of the conductive leads of the flat cable 51.

Each terminal receiving groove 34 has the form of a substantially linear through-hole, which is defined by the upper part 35 and an upper shoulder portion 35*a* and the lower part 32 and a lower shoulder portion 32*a* that constitute ceiling and floor surfaces, respectively. A body part 42 of each terminal 41 is also formed substantially rectangular and, from which a projection 42*a* extends. A lower arm beam 43 and an upper arm beam 44 are formed at the tip of the body part 42, and either have the same vertical width dimension as the body part 42 or are formed smaller than the vertical width dimension. The body parts 42 are connected together by a central connecting part 48 that maintains the bilateral symmetry. Each terminal 41 may be inserted up to the shoulder portions 35*a* and 32*a* (FIG. 3), without abutment of the respective projections 42*a* against the ceiling surface, and as soon as the projections 42*a* arrive at the shoulder portions 35*a* and 32*a*, the projections 42*a* are blocked and securely fixed to the housings 31.

Thus, the shape of the housings 31 is simplified by forming the terminal-receiving grooves 43 as substantially linear through-holes. The gates of a mold for molding the housing 31 can be fewer, enabling the mold to be constructed without complexity. Further, the loading and fixing of the terminals to the housings 31 as well as connecting the housings 31 together can be achieved only by a linear one-way manual operation, facilitating assembly operation.

Auxiliary metallic bracket fitting grooves 36, (FIG. 2) into which stoppers 21 are fitted, are formed at locations in both sides of the lower part 32 of each housing 31 and are preferably adjacent to the sidewalls. The stoppers 21 may be metal brackets, one each, and are fitted into the auxiliary grooves 36 on both sides. The stoppers 21 prevent the actuators 11 from being disengaged from their housings 31. Each of the stoppers 21 is provided with an ear holding recess part 22 that is recessed downward from an upper edge. Therefore, positioning and withdrawal avoidance of the flat cables 51 is achieved attained by holding ear parts 52 of the flat cables 51, in the ear holding recess parts 22. Engaging projections 36*a* project inwards and are formed on the sidewalls above the auxiliary fitting grooves 36. The engaging projections 36*a* come into engagement with side projections 16 of the actuators 11 when closed, and hold the actuators 11 closed.

Each housing 31 further has a connecting arm 37 as a connecting member that extends backward from adjacent to one sidewall at the rear face. Each housing also has a location adjacent to the other sidewall at the rear face, a connecting arm holding recess 38 as a holding recess part, into which the connecting arm 37 of the opposing housing 31 is inserted. An engaging projection 37*a* (hook) projecting upward is formed at a free end of the connecting arm 37, so as to be engaged with an engaging recess portion 38*a* formed within the connecting arm holding recess 38. Thus, as shown in FIG. 2, with the two housings 31 connected back to back, each of the arms 37 is held within the objective connecting arm holding recess 38, and the engaging projection 37*a* is engaged with the engaging recess portion 38*a*, so that the two housings 31 are secured together.

Each actuator 11 is a substantially rectangular thick plate member, and has a body part 15 that is manually operated by an operator, and side projections 16 projecting from the opposite sidewalls of the body part 15. The actuator 11 has a pressing part 14, which, when the actuator 11 is closed, the flat cable 51 inserted therein is pressed downward toward the lower arm beams 43 of the terminals 41.

Figure 2:
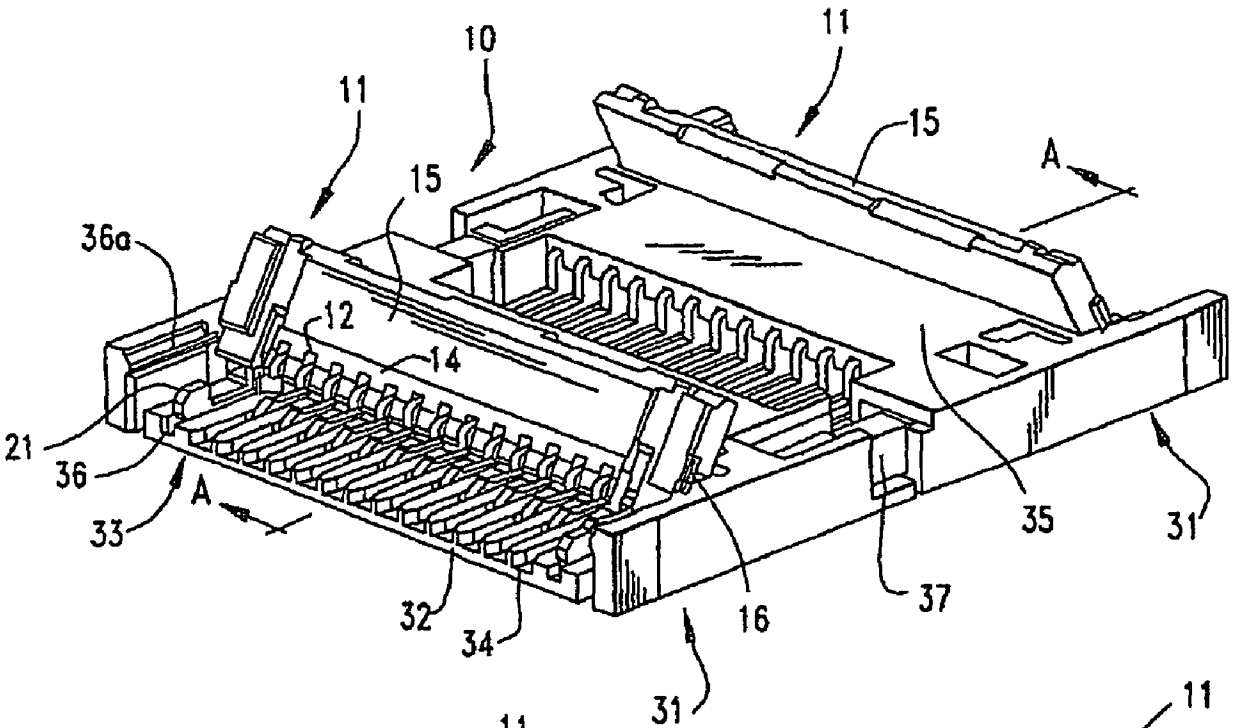
FIG. 2 is a perspective view of the connector FIG. 1 assembled together with the actuators in an open position.
Figure 3:
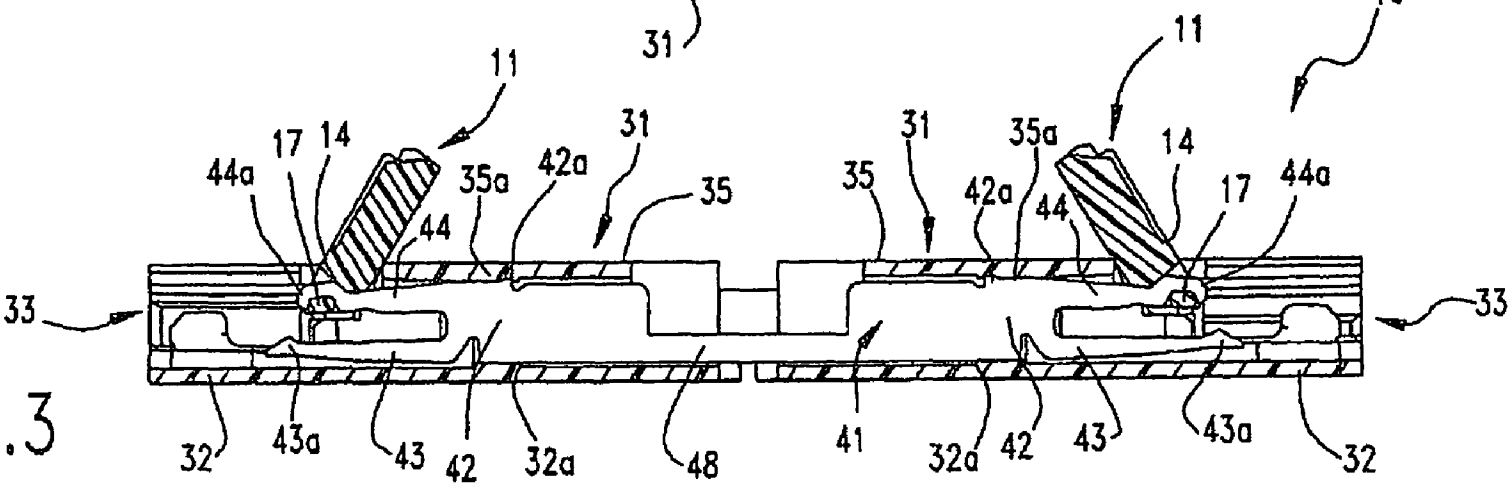
FIG. 3 is a cross-sectional view of FIG. 2 taken along line A-A thereof.

As shown in FIG. 2, the pressing part 14 of the actuator permits insertion of the flat cable 51 when the actuator 11 is open. The end of this pressing part 14 has holding holes 12 for holding the upper arm beams 44 of the terminals 41. As shown in FIG. 3, actuator shafts 17 are engaged with bearing parts 44*a* of the upper arm beams 44 within the holding holes 12. Each actuator 11 is secured along a front side edge of the housing upper part 35. When the actuator 11 is closed, it covers the area of the lower part 32 that projects forward from the housing upper part 35. When the actuator 11 is open, as shown in FIG. 2, it opens above the area of the lower part 32 that projects ahead of the upper part 35.

As shown in FIG. 3, each terminal 41 is symmetrical with respect to a line orthogonal (or vertical) to a longitudinal direction, namely bilaterally symmetrical, and is provided with the body parts 42 on its right and left sides. Both body parts 42 are held within the opposing housings 31, and are further connected to each other by their center connecting part 48. The upper and lower ends of the body parts 42 are sandwiched between (vertically) by the surfaces constituting the ceiling surfaces and the floor surfaces of the terminal receiving grooves 34. Additionally, the terminal projections 42*a* projecting upward from the upper ends of the body parts 42 grip part of the ceiling surfaces of the terminal receiving grooves 34. This fact further enhances the connecting state between the body parts 42 and the housing 31.

The upper arm beams 44 and the lower arm beams 43 of the terminals 41 extend toward the front sides of the housings 31 from the body parts 42, and the rear ends of the upper arm beams 44 and the lower arm beams 43 are connected together by the body parts 42, so that they have a substantially U-shape or C-shape member opening, and are held in the terminal-receiving grooves 34. Each flat cable 51 is inserted into a space between the corresponding upper and the lower arm beams 43 and 44.

The lower arm beams 43 functions as a contact portion that connects to the conductive lead of the flat cable 51, and the contact portion 43*a* projects upward at the tip of the lower arm beam 43. When no flat cable 51 is inserted the lower arm beams 43 are resilient and are slightly obliquely upward so that the lower ends at the terminal tips are above the floor surfaces of the terminal receiving grooves 34.

The bearing parts 44*a* that are formed near the tips of the upper arm beams 44 enter into the holes 12 of the actuators 11 and limit the upward movements of the shafts 17. The lower surfaces of the bearing parts 44*a* contact the shafts 17. The shapes of cross sections of the bearing parts 44*a* are preferably irregular.

As shown in FIGS. 2 and 3, when the actuators 11 are open, the space above the areas of the lower parts 32 of the housings 31 is open, and accordingly smooth insertion of the ends of the flat cables 51 into the openings 33 is permitted. The space between the upper arm beams 44 and the lower arm beams 43 can be wide enough for permitting the flat cables 51 to be inserted with little or no contact pressure from the contact parts 43*a*. This creates a substantially ZIF (zero insertion force) structure.

Figure 4:
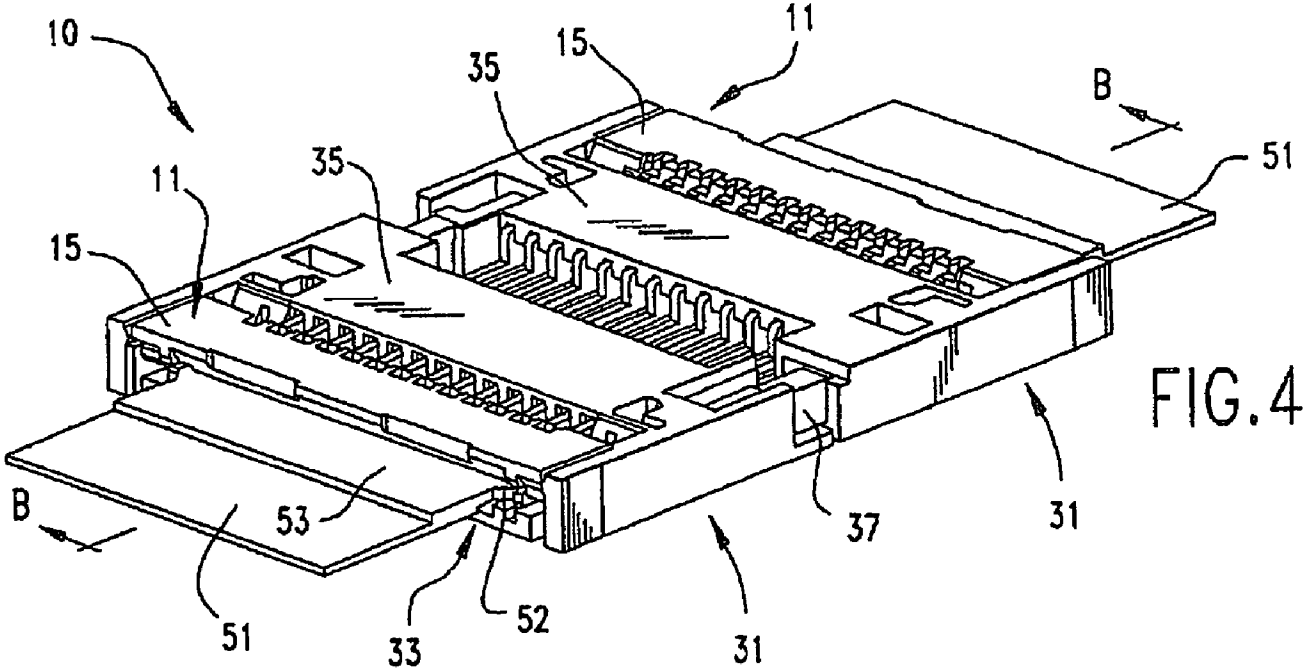
FIG. 4 is the same view as FIG. 2 but showing the actuators in the closed position.
Figure 5:
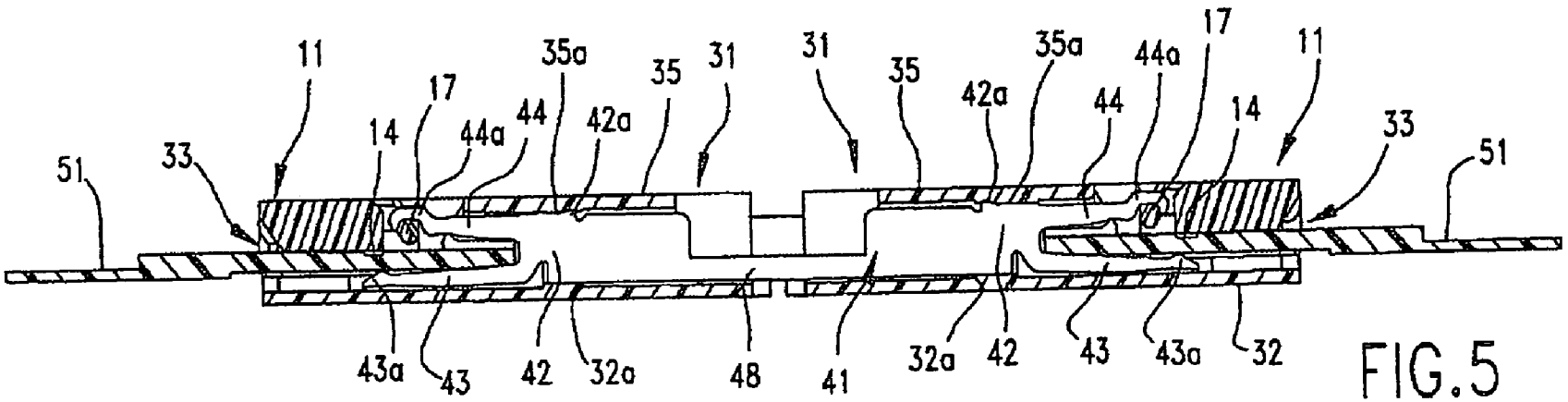
FIG. 5 is a cross-sectional view of FIG. 4 taken along line B-B thereof.

FIG. 4 shows the actuator in the closed position thereof. Each of the flat cables 51 has a plurality of conductive leads arranged side by side at a predetermined pitch, for example, about 0.5 mm, and disposed on an insulating layer. Another insulating layer overlies and covers the conductive leads. At the end of the flat cable 51, the upper surfaces of the conductive leads are exposed over a predetermined range of length. In FIGS. 4 and 5, the conductive leads are exposed on the lower surface of the flat cable 51. An auxiliary plate 53 of increased thickness is provided at the end portions of the cables 51. The auxiliary plate 53 is formed of a material with a relatively high hardness, such as polyimide, extends over a predetermined lengthwise range, and over the entire width of the flat cable 51. Ear parts 52 are formed on both sides of the flat cable 51 and project outward.

When connecting the flat cables 51 to the connector 10, the ends of the flat cables 51 are inserted into the insertion openings 33 of the housings 31. As shown in FIGS. 2 and 3, the actuators 11 are open. The operator then inserts the ends of the cables 51 into the openings 33. The flat cables 51 are moved in while the auxiliary plates 53 face upwardly, and the surfaces of the flat cables 51 that have the conductive leads exposed thereon face downwardly.

The tip ends of the cables 51 are then inserted into the space between the upper arm beams 44 and the lower arm beams 43 of the terminals 41 held in the terminal-receiving grooves 34. The ear parts 52 of each flat cable 51 are inserted into the ear holding recess parts 22 of both stoppers 21 in the auxiliary bracket fitting grooves 36 to complete the insertion of the flat cables 51.

Subsequently, the operator manually operates the actuators 11 into their closed position (FIGS. 4 and 5). The left actuator 11 as viewed in FIG. 3 moves counterclockwise, while the actuator 11 moves clockwise.

The actuator pressing parts 14 are rotated to face down, so that they are nearly parallel to the insertion direction of the flat cables 51 (FIG. 5). The pressing parts 14 abut against the upper surfaces of the auxiliary plates 53, and apply a downward force to press the flat cables 51 against the lower arm beams 43 of the terminals 41. The conductive leads of the flat cables 51 contact with terminal contact portions 43 to connect the cable and terminals together. It should be appreciated that the lower beams 43 have resiliency and therefore are resiliently deformed due to a pressure exerted by the flat cables when the latter is pressed, and maintain a good connection between the conductive leads and the contact parts 43*a*.

When the actuators 11 are closed, the ends of the flat cables 51 are entirely covered with the body parts 15 and the whole of the end portions of the flat cables 51 is held against any upward movement. This eliminates disengagement of the ear parts 52 of the flat cables 51 from the ear holding recess parts 22. Therefore, if the flat cables 51 are subjected to a force in the opposite direction of the direction of insertion, the flat cables 51 are prevented from being disengaged from the insertion openings 33 by engagements of the ear parts 52 with their corresponding holding recess parts 22.

Thus, when the flat cables 51 are connected together by inserting them from the insertion openings 33 of the connector 10, the conductive leads of the respective flat cables 51 and the terminals 41 can be electrically connected to each other, so that the conductive leads of the both flat cables 51 are eventually electrically connected to one another.

In the connector 10 of the first embodiment, both of the actuators 11 can be independently operated, i.e., they can individually change from an open to a closed position. Hence, after connecting one of the flat cables 51 to the connector 10 in the above-mentioned manner, the other flat cable 51 can be connected to the connector 10 in the same manner. Hence, the operator is able to reliably connect the flat cables 51 to the connector 10 without failure, thereby improving easiness, reliability, and speediness of connecting operation. Furthermore, one flat cable 51 and the other flat cable 51 can be connected to the connector 10 at times or different operation sites, thereby increasing the degree of freedom of connecting operation.

The description of operation of assembling the above-mentioned connector 10 will be provided hereinbelow.

As in FIG. 6A, the terminals 41 are inserted into the terminal-receiving grooves 34 of one housing 31 from the rear face thereof. Specifically, the body part 42, the upper arm beam 44, and the lower arm beam 43 of the terminals 41 are initially inserted and fitted into the corresponding terminal receiving groove 34 of such one of the housings 31. The upper end and the lower end of the inserted body part 42 are sandwiched and secured vertically by the ceiling surface and the floor surface of the terminal-receiving groove 34. The projection 42*a* grips a part of the ceiling surface of the terminal-receiving groove 34 so that the body part 42 and the housing 31 are surely connected together. Hence, loading of the first one of the terminals 41 into the terminal receiving groove 34 is completed. Repeating a similar operation with respect to all of the remaining terminals 41 completes secure fitting of all of the terminals 41 into one of the housings 31.

Referring to FIG. 6B, the other housing 31 is then secured to the terminals 41 securely fitted into the one housing 31. Specifically, all of the body parts 42, the upper arm beams 44 and the lower arm beams 43 of all of the terminals 41 on the other side are simultaneously inserted from the rear face side of the other housing 31 into all corresponding terminal-receiving grooves 34. All the upper ends and the lower ends of the terminal body parts 42 are sandwiched between the ceiling surfaces and the floor surfaces of the terminal-receiving grooves 34, to thereby surely connect the body parts 42 and the other housing 31.

The connecting arms 37 of both housings 31 are then inserted into the connecting arm holding recess 38 of the opposite housing 31. Then the engaging projections 37*a* of the connecting arms 37 are engaged with the engaging recess portion 38*a* in the connecting arm holding recess 38. Thus, the secure fitting of all of the terminals 41 into the other housing 31, and the interconnection of the two housings 31 is completed.

Figure 6:
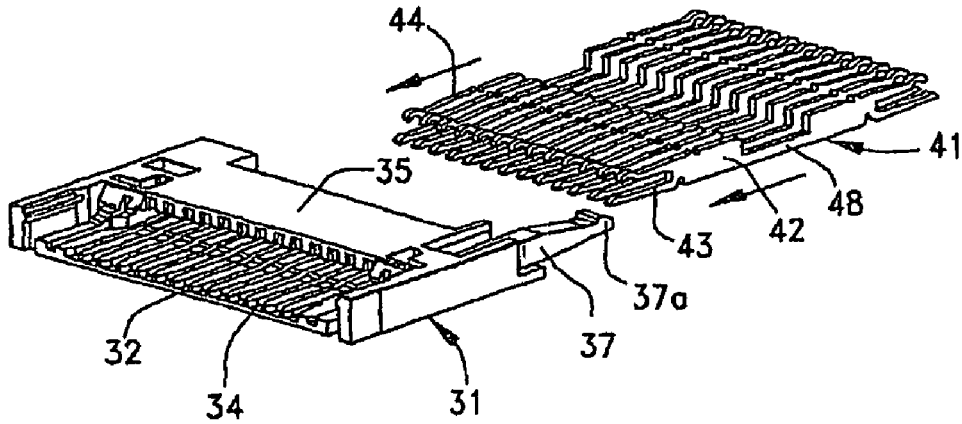
FIGS. 6A to 6C are perspective views showing assembly processes of the connector of FIG. 1.
Figure 6:
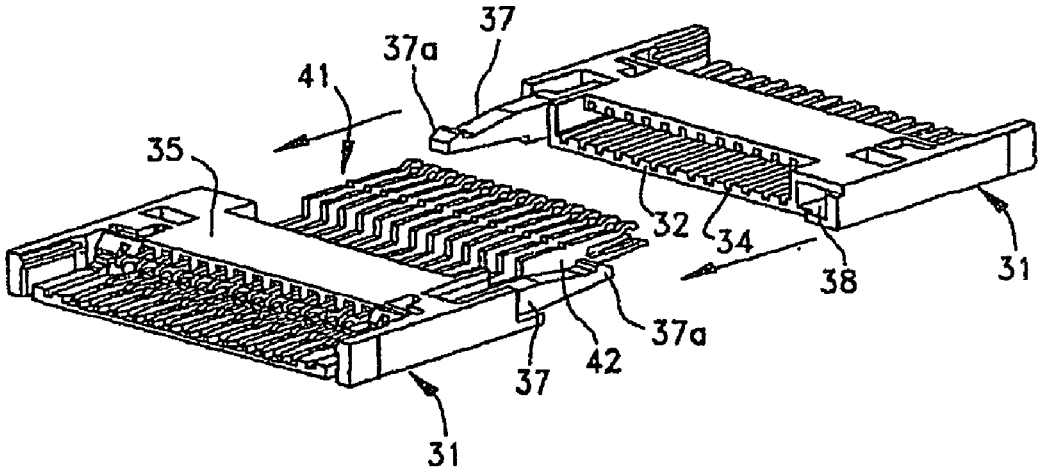
Figure 6:
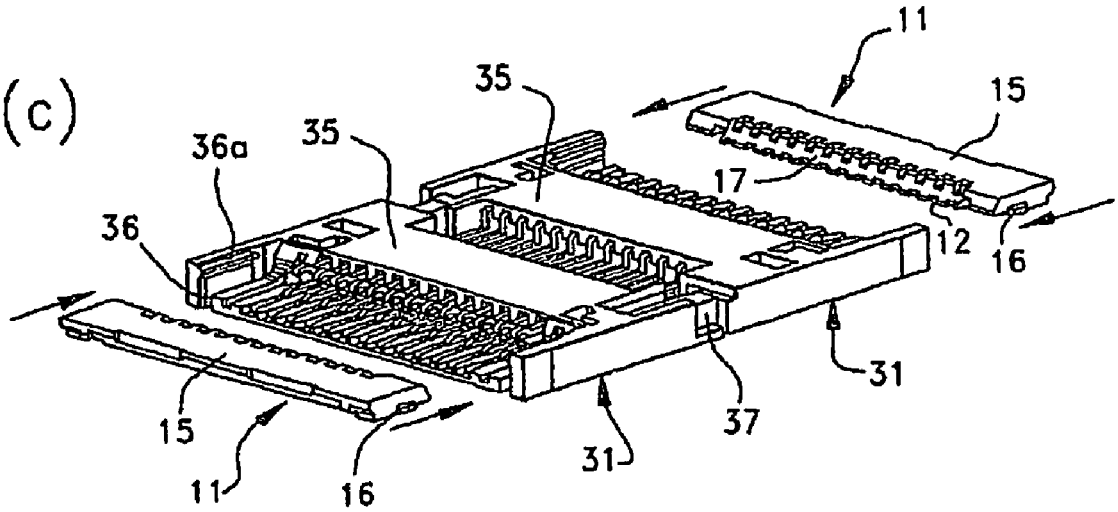

A pair of actuators 11 are next mounted on the two housings 31 (FIG. 6). The actuators 11 are shifted from the front of the housings 31 toward the front side edge of the upper part 35, so that the upper arm beams 44 of the terminals 41 are inserted into the holding holes 12 of the respective actuators 11, and so that the actuator shafts 17 are shifted below the bearing parts 44*a* of the upper arm beams 44. This completes the mounting of the actuators 11 onto the housings 31. The actuators 11 may be sequentially fit to the housing one by one. The actuators 11 so mounted are in the close position thereof.

Figure 7:
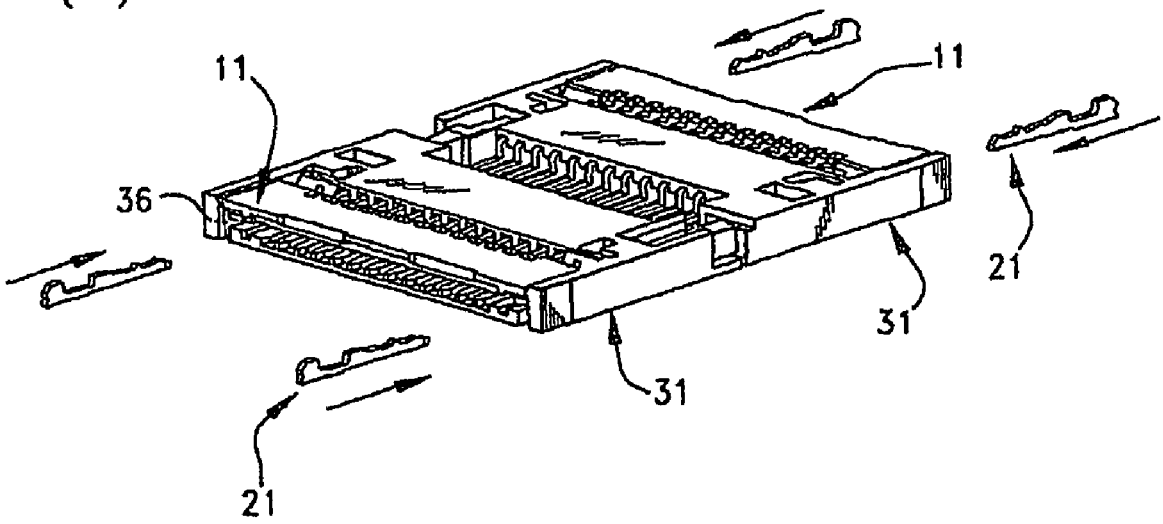
FIGS. 7A and 7B are perspective views showing another assembly process of the connector of FIG. 1.
Figure 7:
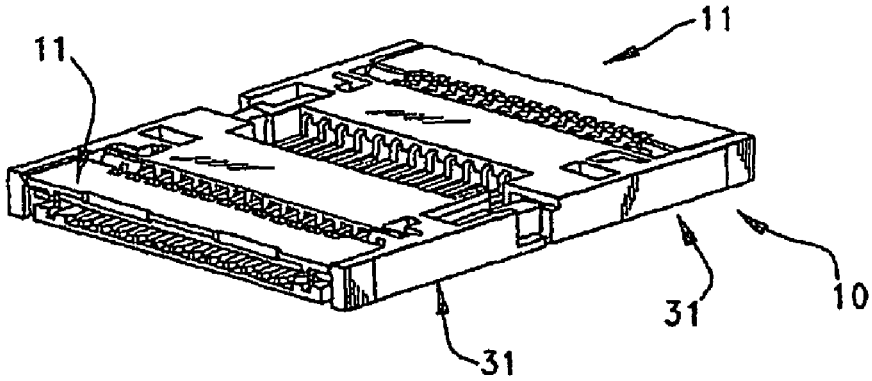
Figure 8:
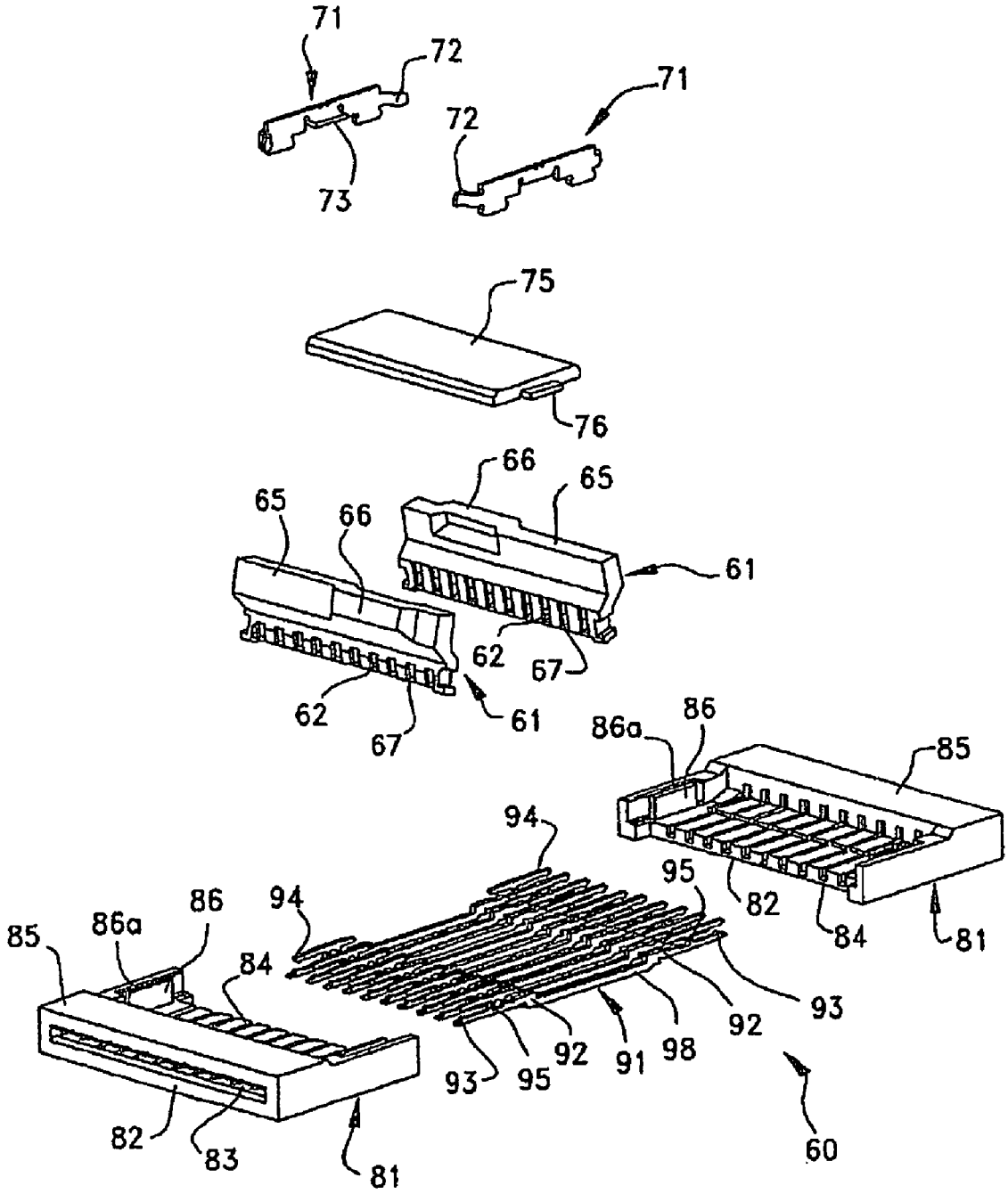
FIG. 8 is an exploded perspective view of a connector of a second preferred embodiment of the present invention.

Referring to FIG. 7A, the stoppers 21 are loaded into the auxiliary bracket fitting grooves 36 of the housings 31. The stoppers 21 are press-fit into the auxiliary bracket fitting grooves 36 from the front of the housings 31. The upper surfaces of the stoppers 21 abut against the lower surfaces of both side ends of the actuators 11, so that an upward force is applied to the actuators 11. As a result, the shafts 17 of the actuators 11 are engaged with the bearing parts 44*a* of the upper arm beams 44. Thus, the mounted actuators 11 are prevented from being disengaged from the housings 31.

Therefore, the structures of the housings 31 and the actuators 11 can be simplified facilitating easy manufacturing and easy assembly.

The housings 31 have the same structure, and the actuators 11 also have the same structure, and the terminals 41 are of bilaterally symmetrical shape. To this end, manufacturing of a mere single type of the housings 31, a mere single type of the actuators 11, and a mere single of the terminals 41 is permitted while facilitating easy manufacture of every part of the connector 10 and lowering of the manufacturing cost.

The housings 31 are interconnected with each other so that the insertion openings 33 open toward opposite directions. This permits the butt connection of the two flat cables 51.

The housings 31 are connected by the terminals 41 and the connecting arms 37, so that the right and left housings 31 are reliably connected.

The lower arm beams 43 are connected to each other. This enables a single terminal 41 to provide reliable connection of the leads of the flat cables 51 inserted into the insertion openings 33 from the right and left sides.

The actuators 11 can change their respective positions independently, allowing the flat cables 51 to be connected one by one to the connector 10. This improves easiness, sureness and quickness of connecting operation, and also enhances the degree of freedom of connecting operation.

A second embodiment of the present invention will now be discussed.

Reference numeral 60 generally designates a connector of the present invention, which is used to provide connection between flat cables 51. This second connector 60 has a pair of housings 81, a pair of actuators 61, and common terminals 91. The housings 81 are insulative and have the same structure and are connected together back-to-back. The actuators 61 are formed of an insulative material, and function as movable members to secure the cables. The actuators 61 are movably mounted on each of the housings 81. Each actuator 61 is disposed in the corresponding housing 81 so as to move between an open (first) position, and a closed (second) position. The terminals 91 are integrally formed of a conductive material and are common to both housings 81, and are securely held by the housings 81. The terminals 91 are also bilaterally symmetrical and, the right and left portions thereof are disposed in the right and left housings 81, respectively.

Each of the housings 81 is formed in a shape like a rectangular thin box, and has a lower part 82, an upper part 85, and an insertion opening 83, through which the end of the flat cable 51 is inserted from the front 85. The insertion opening 83 has a plurality of terminal receiving grooves 84, each of which holds a terminal 91. The terminals 91 are loaded, one after another, into the terminal-receiving grooves 84. The number and the pitch of the terminal receiving grooves 84 may be suitably changed. The terminals 91 are not necessarily required to be loaded into each of the terminal receiving grooves 84. Some of the terminals 91 might be omitted appropriately depending on the array of the conductive leads of the flat cables 51.

Auxiliary walls 86 extend upward from both sides of the lower part 82 and are formed inside of the sidewalls on both sides of each housing 81 and are located at positions in the vicinity of the rear face of the housing 81. An auxiliary bracket receiving groove 86*a* is formed as a slit-shaped engaging part between each auxiliary wall 86 and the corresponding sidewall. Stoppers 71 in the form of auxiliary metallic brackets are loaded, one by one, into the auxiliary bracket-receiving grooves 86*a* on both sides. Each stopper 71 has connecting engagement parts 72 on both ends in a lengthwise direction, respectively, and has a cover engaging part 73 in the middle part in the lengthwise direction. The stoppers 71 prevent the actuators 61, once secured to the housings 81 from being disengaged from the housings 81, and prevent the cover member 75 secured to the two connected housings 81 from being disengaged. The stoppers 71 further function as a connecting member for connecting the two housings 81. The stoppers 71 prevent disengagement of the cover member 75 by virtue of cover engaging parts 73 that abut against the upper surfaces of projections 76 and engage of the same cover engaging parts 73 with the upper surfaces of the projections 76 provided on the cover member 75. The stoppers 71 prevent the two housings 81 from being disconnected from each other by engagements of connecting engagement parts 72 with the ends of the auxiliary walls 86 of both housings 81.

Figure 10:
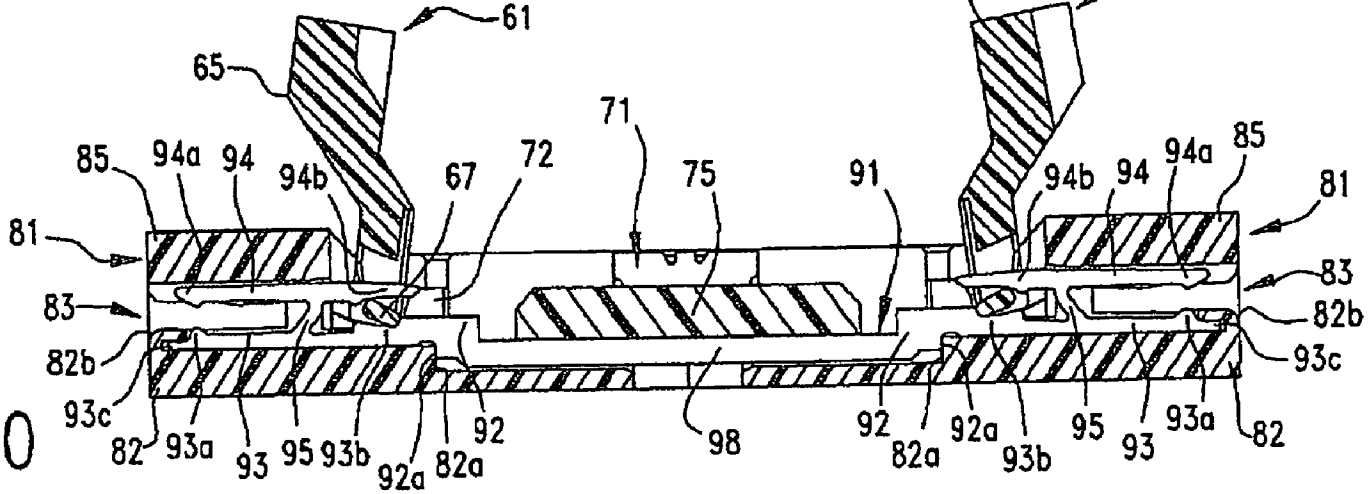
FIG. 10 is a cross-sectional view of FIG. 9 taken along line C-C thereof.

Each actuator 61 has a body part 65 that is a substantially rectangular thick plate member, with an operation part 66 that is expanded from the body part 65 formed to enable the operator's finger and hand to be easily engaged therewith. The operation parts 66 are dislocated from the central position in a direction of width of the body part 65, namely they are eccentrically formed. Thus, when the two actuators 61 are closed, the operation parts 66 are spaced apart from each other, enhancing the operability through the operator's finger and hand. The actuator 61 has, at the end on the side opposite to the operation part 66, a plurality of holding holes 62 for holding actuating levers 94*b* of the upper arm beams 94 of the terminals 91. As shown in FIG. 10, shafts 67 engaged with the actuating levers 94*b* of the upper arm beams 94 are formed within the holding holes 62. The actuators 61 are secured along a rear side edge of the upper parts 85 of the housings 81. When the actuators 61 are closed, they cover the areas of the lower parts 82 which project backward past the upper parts 85. When they are opened, as shown in FIG. 10, they keep open the areas of the lower parts 82 which project forward than the upper parts 85.

As shown in FIG. 10, each terminal 91 is bilaterally symmetrical, and provided with the body parts 92 on the right and left sides, respectively. Both of the body parts 92 are held within both housings 81, and are connected to be integrated with each other by a connecting part 98.

Lower arm beams 93 extend forward of the housings 81 from the body parts 92. Disposed above the lower beams 93 are upper arm beams 94 that are connected via connecting beams 95 to the lower arm beams 93, and extend parallel with the lower arm beams 93. The upper arm beams 94, the lower arm beams 93, and the connecting beam 95 are of substantially H-shape, and are held within the terminal receiving grooves 84. Each cable 51 is inserted from the front into a space between the upper arm beams 94 and the lower arm beams 93.

Each lower arm beam 93 has a tip projection 93*c*, a cable supporting part 93*a* that projects upward near the tip and backward of the tip projection 93*c*, and a bearing part 93*b* connected to the body part 92 and located at the rear end. The terminals 91 may be secured to the housings 81 by allowing a substantially linear lower end of the lower arm beams 93 to come into abutting contact against the floor surfaces of the terminal receiving grooves 84, and allow the tip projections 93*c* to fit into recess parts formed in the front end walls of the terminal receiving grooves 84, and also allow projections 92*a* that project forward from shoulder parts of the body parts 92 to grip part of the surfaces of the shoulder parts of the terminal receiving grooves 84.

Thus, with the shape in which a shoulder portion 82*a* and a recess part 82*b* are formed in an opposite direction of the insertion openings 83, and the terminal receiving grooves 84 are substantially linearly formed, the shape of the housings 81 is simplified. The gating directions of a mold for forming the housings 81 can be reduced, resulting in preventing the metallic mold from becoming complicated.

The terminal body parts 92 are connected bilaterally symmetrically and linearly by the connecting parts 98, and the upper arm beams 94 and the lower arm beams 93 that are formed ahead of the connecting parts 98 are disposed in a direction of assembly of the pair of the housings 81, thereby facilitating assembly operation of the housings 81. Further, the two body parts 92 can be secured so as to be sandwiched by the shoulder portion 82*a* of both housings 81, and the opposite projections 93*c* of the respective terminals 91 can also be secured so as to be sandwiched by the recess parts 82*b* of the housings 81, without requiring any strong engaging means for securing the terminals 91 to the housings 81. This also facilitates the assembly operation.

The upper arm beams 94 are able to function as contact pieces that are electrically connected to the leads of the flat cables 51. Contact parts 94*a* projecting downward are formed in the vicinity of the tips of the upper arm beams 94. The upper arm beams 94 are further provided with shift levers 94*b* that extend more backward than the connecting parts with the connecting beams 95, and enter into the holding holes 62 of the actuators 61 and hold the shafts 67 against upward movements thereof. Each of the shafts 67 is of ellipse or rectangular cross-section, and interposed between the bearing part 93*b* and the actuating lever 94*b*, and functions as a cam upon being rotated, to thereby push the actuating lever 94*b* in an upward direction. When the actuating levers 94*b* are pushed up, the areas near the connecting parts between the upper arm beams 94 and the connecting beams 95 are mainly resiliently deformed, and the whole of the upper arm beams 94 are rotated around the areas near the connecting parts between the upper arm beams 94 and the connecting beams 95, so that the tips of the upper arm beams 94 are shifted downward so as to press the contact parts 94*a* thereat against the conductive leads of the flat cables 51.

Figure 9:
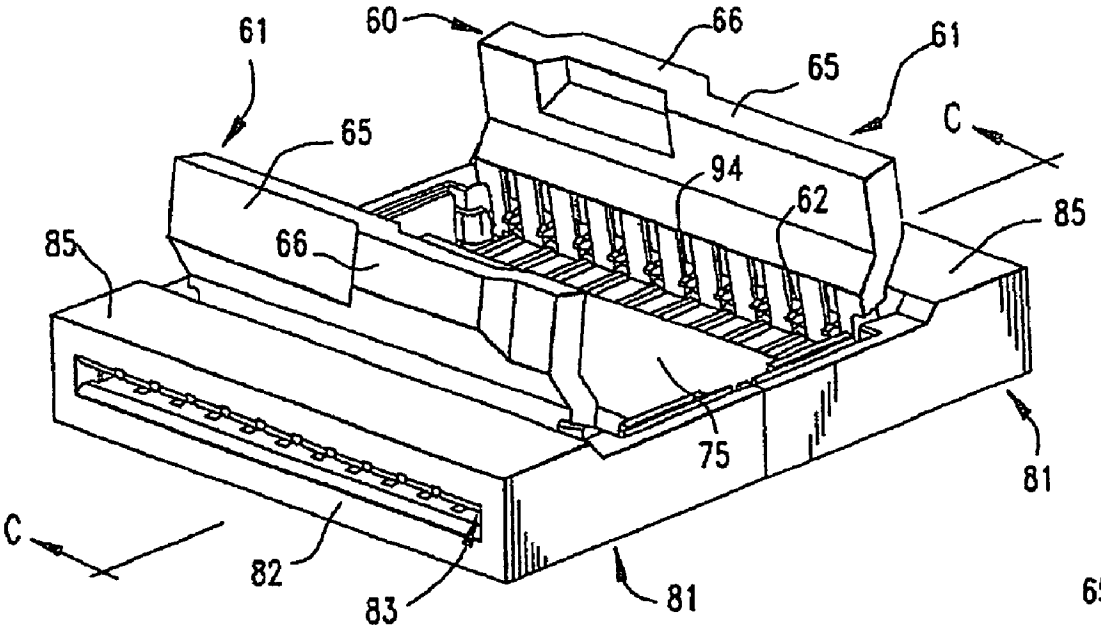
FIG. 9 is a perspective view of the connector of FIG. 8 assembled together and in which the actuators are in an open position.

As shown in FIGS. 9 and 10; when the actuators 61 are open, the shafts 67 come to a position of angle that is approximately horizontal position, so that the actuating levers 94*b* are not pushed up, and the tips of the upper arm beams 94 are not shifted downward. This fact provides sufficiently large space between the tips of the upper arm beams 94 and the tips of the lower arm beams 93, enabling the flat cables 51 inserted from the insertion openings 83 to be inserted under no contact pressure or slight contact pressure from the contact parts 94*a* and the cable supporting parts 93*a*. This realizes a substantially ZIF (zero insertion force) structure.

Additionally, the cover member 75 is arranged so as to cover over a wide range of region above the connecting parts 98, as shown in FIGS. 9 and 10. This surely prevents the operator's finger and hand from contacting with the terminals 91, or prevents dust from adhering to the terminals 91.

When connecting the flat cables 51 to the connector 60, the ends of the flat cables 51 are inserted into the openings 83 of the housings 81. The actuators 61 are brought into the open position. The operator shifts the ends of the flat cables 51 to the openings 83, so that the ends of the flat cables 51 can be moved toward the opening 83. In the second embodiment, the flat cables 51 are moved with the auxiliary plates 53 facing down, and with the surface where the conductive leads are exposed facing up.

The tips of the cables 51 are then inserted into space between the upper arm beams 94 and the lower arm beams 93 of the terminals 91 held within the terminal receiving grooves 84. The ear parts 52 on both sides of the flat cables 51 cannot be inserted into the insertion openings 83, and their front ends abut against the front faces of the housings 81. Thus, the lengthwise positioning of the flat cables 51 is performed to complete the insertion of the flat cables 51.

Figure 11:
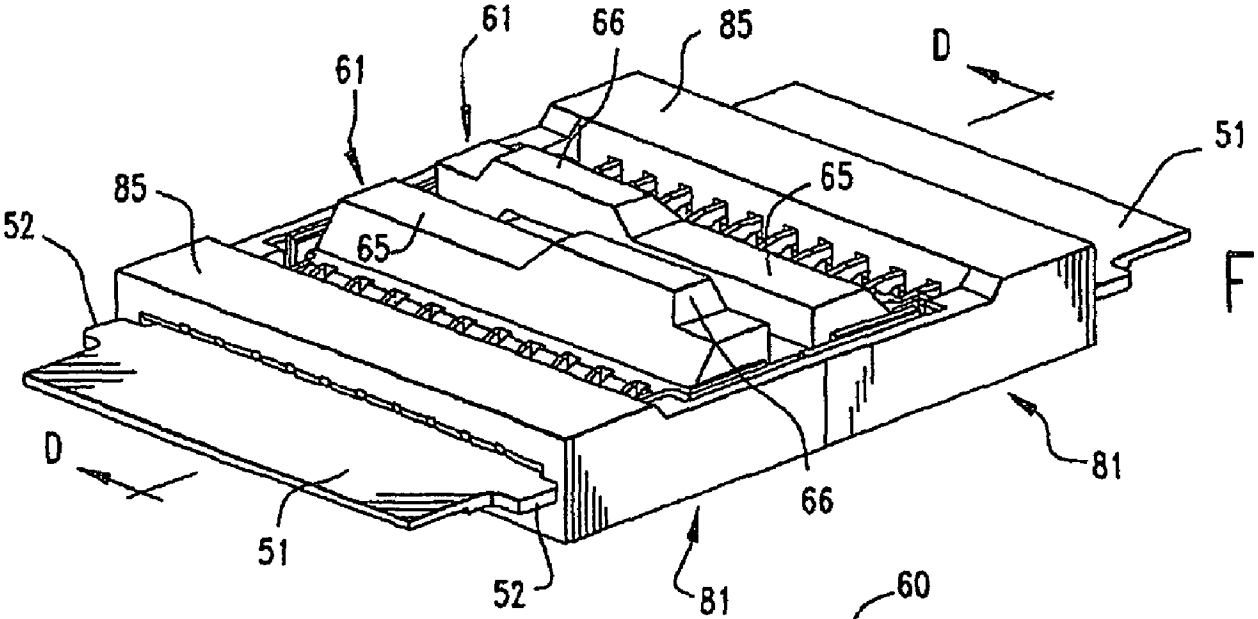
FIG. 11 is the same view of FIG. 9, but with the actuators in a closed position.
Figure 12:
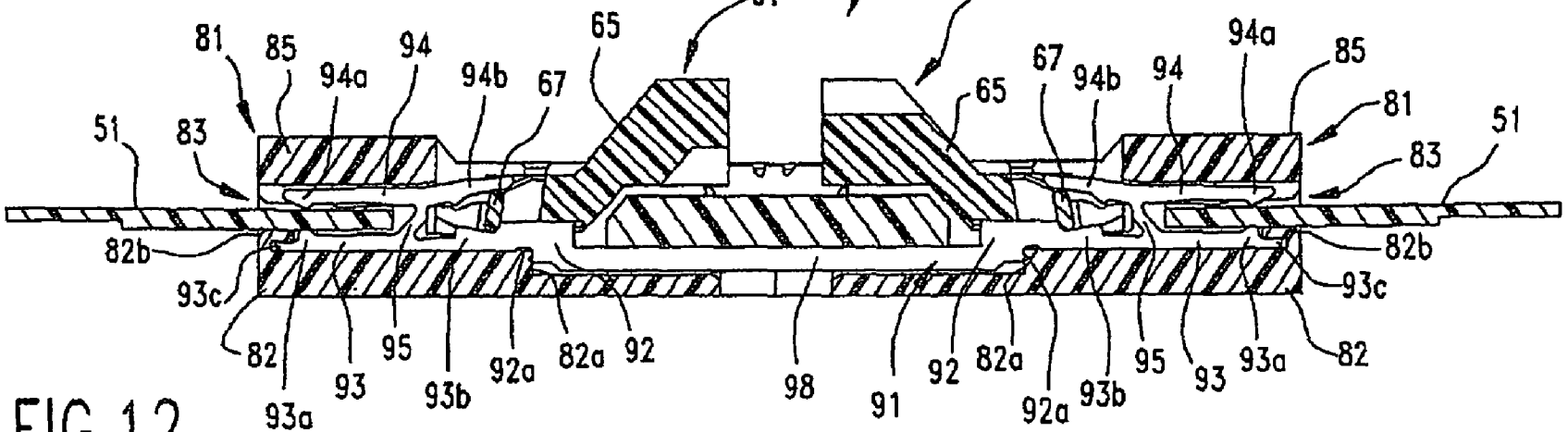
FIG. 12 is a cross-sectional view of FIG. 11 taken along line D-D thereof.

The operator manually closes the actuators as shown in FIGS. 11 and 12. The left actuator moves clockwise and the right actuator moves counterclockwise.

Upon this, the shafts 67 are rotated to a position of angle where it takes an approximately vertical position, as shown in FIG. 12, so that the space between the bearing parts 93*b* and the actuating levers 94*b* is widened, and the actuating levers

94*b* are pushed up. Therefore, the tips of the upper arm beams 94 are shifted downward, and the contact parts 94*a* are pressed against the flat cables 51. As a result, the conductive leads being exposed on the upper surface of the flat cables 51 abut against the contact parts 94*a* thereby to form electrically connecting parts, so that the conductive leads and the terminals 91 are electrically connected to each other. The upper arm beams 94 have resiliency, and therefore are resiliently deformed under pressure exerted by the flat cable 51, enabling the connection between the leads and the contact parts 94*a* to be maintained suitably. Further, since the cable supporting parts 93*a* of the lower arm beams 93 are located at positions opposed to the contact parts 94*a*, the flat cables 51 can be surely supported by the cable supporting parts 93*a*, enabling the connection between the conductive leads and the contact parts 94*a* to be reliably maintained.

Thus, when the flat cables 51 are connected by inserting them from the two insertion openings 83 of the connector 60, the conductive leads of the respective flat cables 51 and the terminals 91 can be electrically connected to each other, so that the conductive leads of both flat cables 51 are electrically interconnected.

In the connector 60 of the second embodiment, both of the actuators 61 can be operated independently with the same benefits as the first embodiment.

Although there has been discussed the case where the flat cables 51 are inserted into the insertion openings 83 by directing upward the surface where the leads are exposed, the flat cables 51 may be inserted into the insertion openings 83 by directing downward the surface where the leads are exposed. In this case, since the cable supporting parts 93*a* of the lower arm beams 93 are located at positions opposed to the contact parts 94*a*, the leads are pressed by the cable supporting parts 93*a* and contacted therewith, so that they are electrically connected to the terminals 91. At this time, the lower arm beams 93 function as contact pieces. That is, in the second embodiment, if the flat cables 51 are disposed upside down, they can be connected to the connector 60, enhancing the degree of freedom of connecting operation.

Furthermore, the operation parts 66 of the actuators 61 are formed eccentrically, as shown in FIG. 11, if the two actuators 61 are in the close position, the operator can easily hook the finger and hand over the operation parts 66. This improves the operability of the connector 60.

The operation of assembling the above-mentioned connector 60 will be described hereinbelow.

Figure 13:
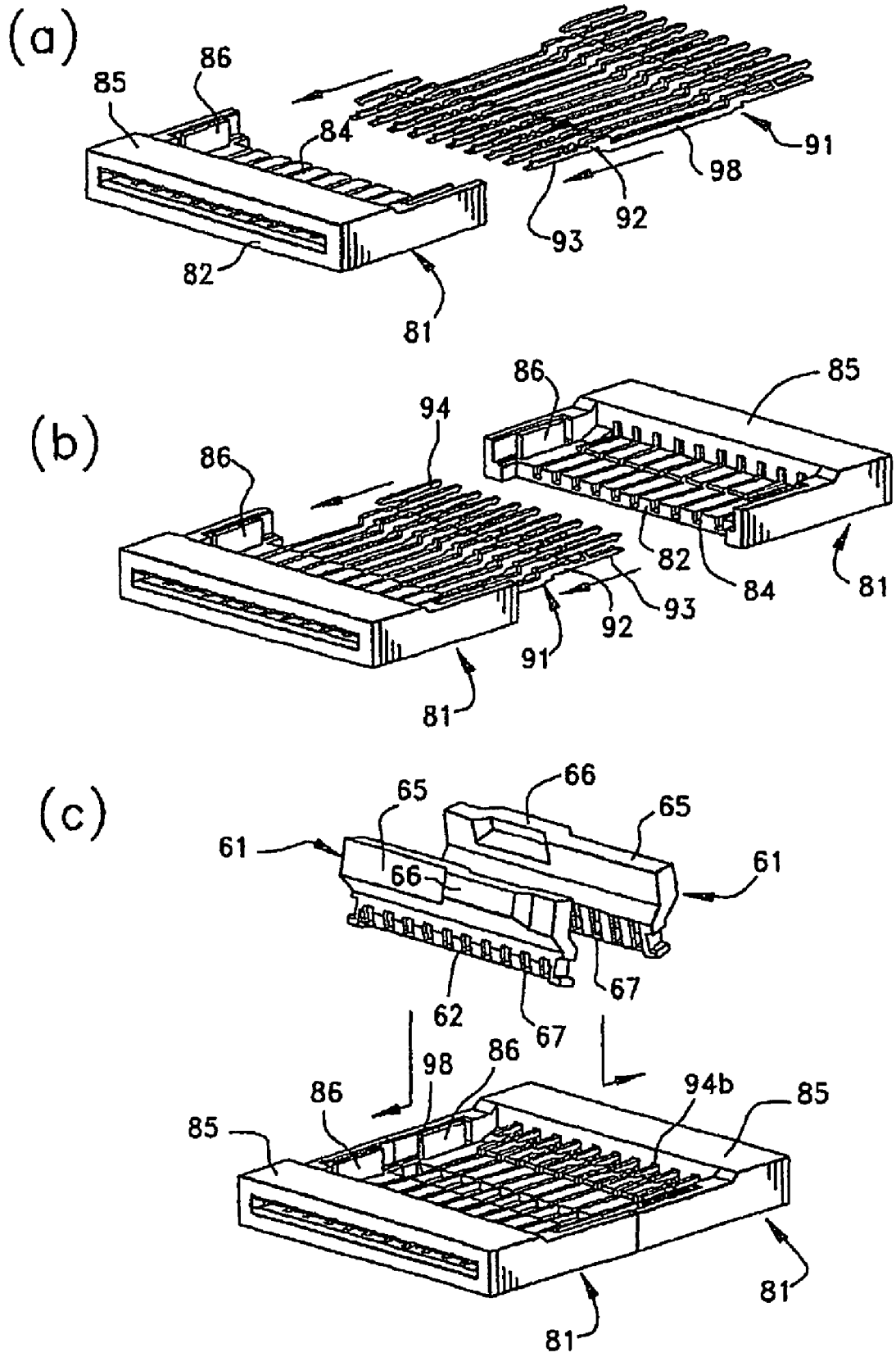
FIGS. 13A to 13C are perspective views showing an assembly process of the connector of FIG. 8.
Figure 14:
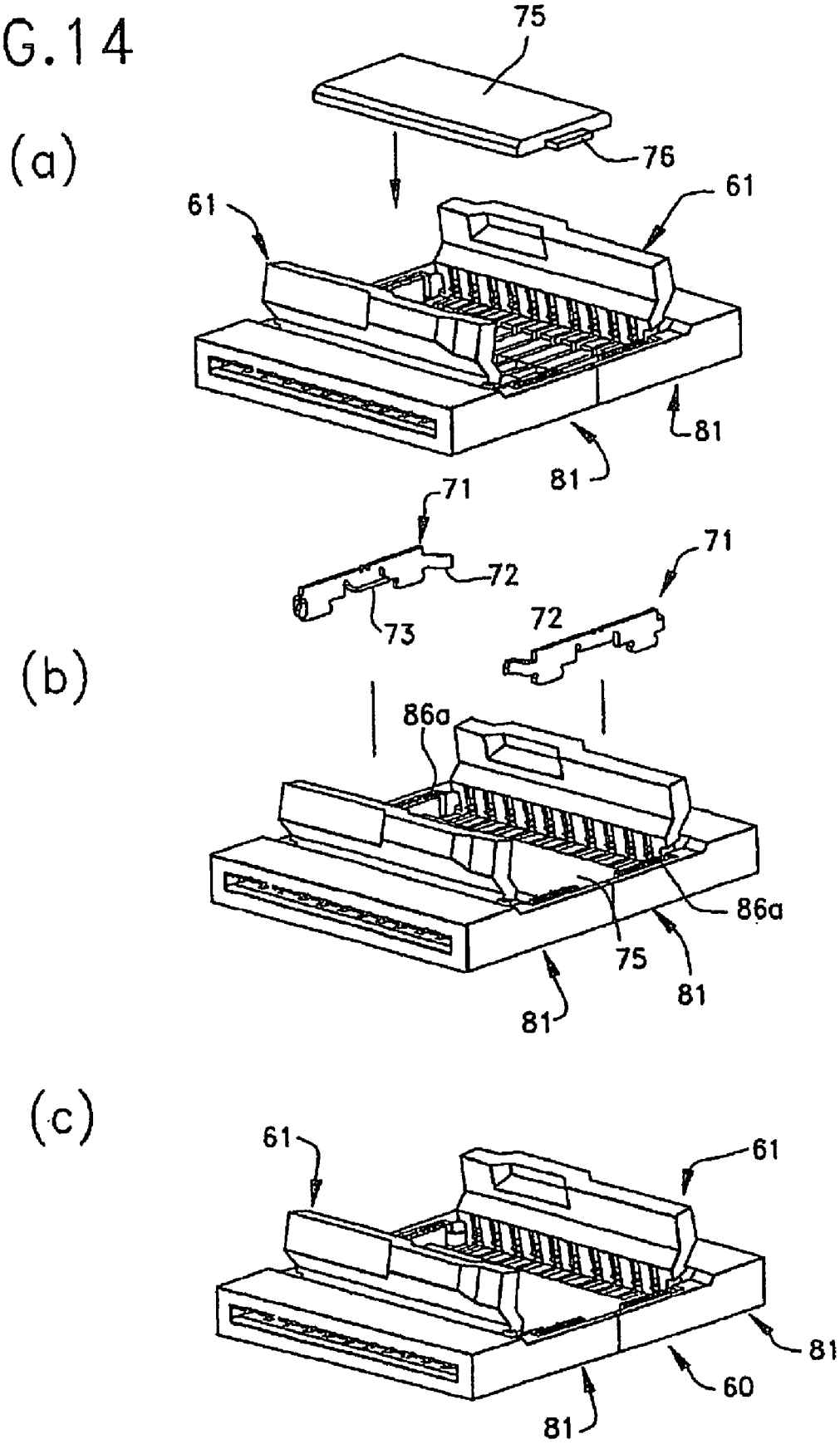
FIGS. 14A to 14C are perspective views showing a subsequent assembly process of the connector of FIG. 8.
Figure 15:
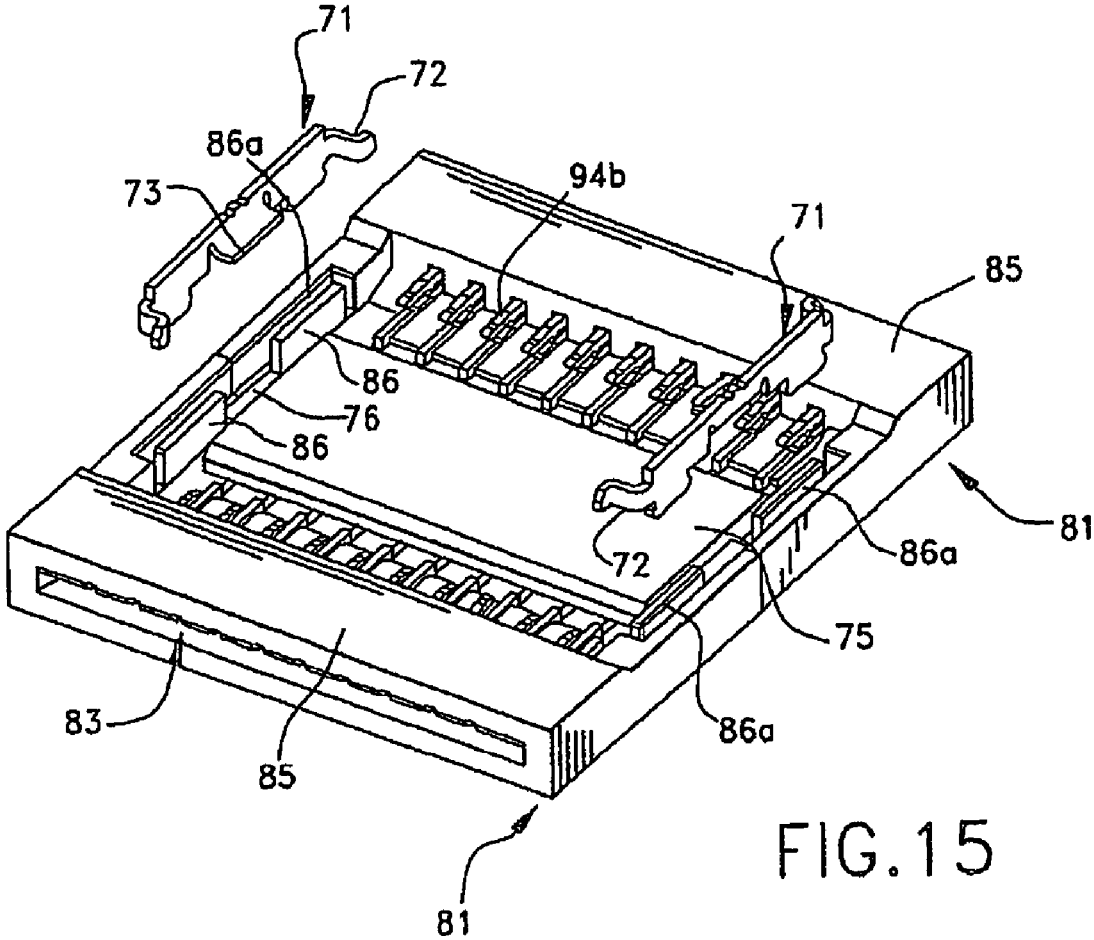
FIG. 15 is a perspective view showing an assembly process of the connector of the second embodiment of the present invention.
Figure 16:
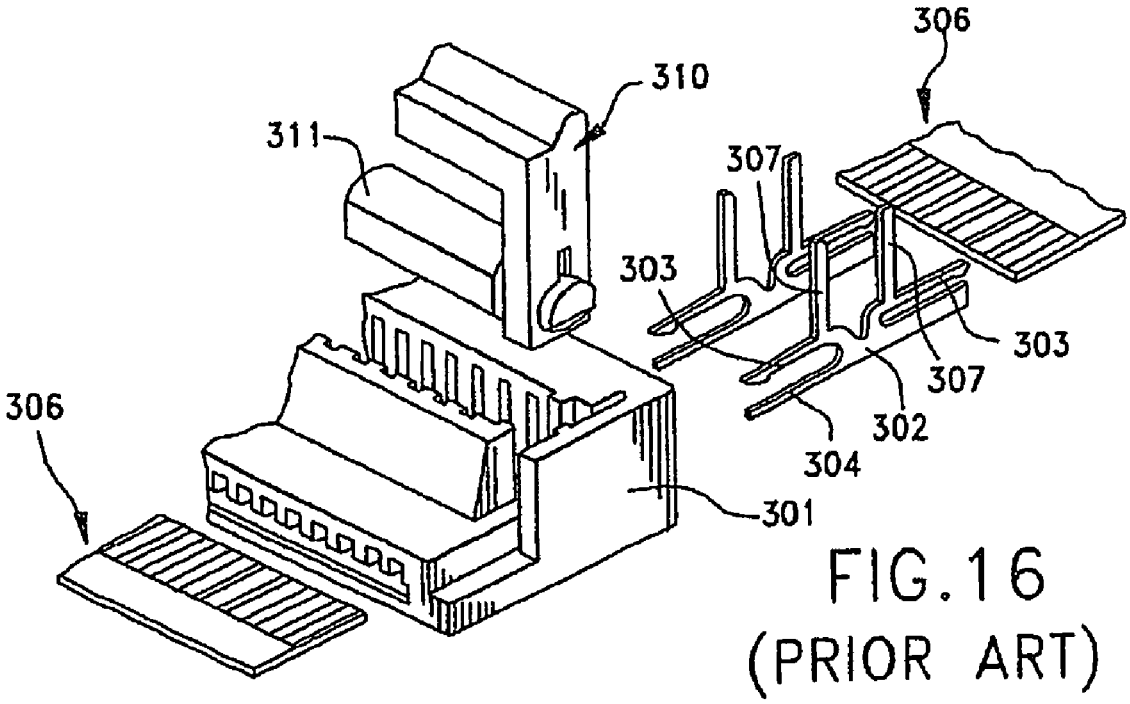
FIG. 16 (PRIOR ART)
FIG. 16 is an exploded perspective view of a conventional relay connector.

FIGS. 13A to 13C are first perspective views showing assembly processes of the connector of the second preferred embodiment of the present invention. FIGS. 14A to 14C are second perspective views showing assembly processes of the connector of the second preferred embodiment of the present invention. FIG. 15 is a third perspective view showing an assembly process of the connector of the second preferred embodiment of the present invention.

Referring first to FIG. 13A, the terminals 91 are inserted into the terminal receiving grooves 84 of one housing 81 from the rear face side thereof. At this time, the terminals 91 are sequentially relatively moved one by one to the their respective corresponding terminal receiving grooves 84, and the body part 92, the upper arm beam 94, and the lower arm beam 93, each of which is opposed to the one housing 81, are then inserted into the terminal receiving grooves 84. The substantially linear lower end of the lower arm beam 93 abuts against the floor surface of the terminal receiving groove 84, and the tip projection 93*c* fit into the recess part formed in the front end wall of the terminal receiving groove 84, and further the shoulder portion of the body part 92 projecting forward from the shoulder portion of the body part 92 grips a portion of the surface of the shoulder portion of the terminal receiving groove 84, so that the terminal 91 is firmly secured to the housing 81. This completes loading of one of the terminals 91 into the terminal receiving groove 84. Repeating a similar operation with respect to all of the terminals 91 completes securing of all of the terminals 91 to the one housing 81.

Referring to FIG. 13B, the other housing 81 is then secured to the terminals 91 securely fitted into the one housing 81. In this case, all of the body parts 92, the upper arm beams 94 and the lower arm beams 93 of all of the terminals 91, each of which is not opposed to the one housing 81, are inserted from the rear face side of the other housing 81 into all of their respective corresponding terminal receiving grooves 84 at the same time. The substantially linear lower ends of the lower arm beams 93 of all of the terminals 91 abut against the floor surfaces of the terminal receiving grooves 84, and the tip projections 93*c* are fitted into the recess parts 82*b* formed in the front end walls of the terminal receiving grooves 84, and further the projections 92*a* projecting from the shoulder portions of the body parts 92 grip a portion of the surfaces of the shoulder portions of the terminal receiving grooves 84, so that the terminals 91 are securely fitted into the other housings 81. This completes loading of all of the terminals 91 into the other housing 81, so that both of the housings 81 are connected to each other.

Referring to FIG. 13C, pair of the actuators 61 are fitted into the two housings 81, respectively. Specifically, the actuators 61 are shifted from the rear face side of the housings 81 to the rear side edge of the upper part 85, and the actuating levers 94*b* of the terminals 91 are inserted into the holding holes 62 of the actuators 61, and the shafts 67 of the actuators 61 are shifted to space between the bearing parts 93*b* and the actuating levers 94*b*. This completes the mounting of the actuators 61 in the housings 81. In this case, the actuators 61 can be sequentially mounted one by one. The actuators 61 so mounted are in the open position.

Referring to FIG. 14A, the cover member 75 is secured from above to the connected area of the two housings 81 so as to cover above the connecting parts 98. Referring to FIG. 14B, the stopper 71 is then loaded into the auxiliary metallic bracket fitting grooves 86*a* of the housings 81. Specifically, the stoppers 71 are press-fitted into the auxiliary metallic bracket fitting grooves 86*a* of the housings 81.

FIG. 15 illustrates in detail the operation of loading the stoppers 71 into the auxiliary metallic bracket fitting grooves 86*a*. For the sake of brevity in explanation, the illustration of the actuators 61 is omitted. The cover member 75 is secured so that the projections 76 fit into space between the auxiliary walls 86 of both housings 81. When the stoppers 71 is pressed from above into the auxiliary metallic bracket fitting grooves 86*a*, the cover engaging parts 73 enter into between the auxiliary walls 86 of both housings 81, and engage from above with the projections 76 of the cover member 75. As a result, the projections 76 are engaged to the stoppers 71 thereby to prevent disengagement of the cover member 75. The connecting engagement parts 72 at the opposite ends of the stopper 71 are engaged with the ends of the auxiliary walls 86 of both housings 81. This prevents the connected two housings 81 from being disengaged from each other. The connecting engagement parts 72 also hold both side ends of the actuators 61 against backward movement. This eliminates the possibility that the actuators 61 backwardly move and the shafts 67 are moved apart from the space between the bearing part 93*b* and the actuating levers 94*b*. Consequently, the mounted actuators 61 are held against disengagement from the housings 81.

On termination of loading of all of the stoppers 71, the assembly of the connector 60 is completed, as shown in FIG. 14C.

Thus, in the second embodiment of the present invention, the connector 60 has (i) the pair of the housings 81 provided with the insertion openings 83, through which the flat cables 51 is inserted; (ii) the terminals 91 that are commonly loaded into the respective housings 81, and provided with the upper arm beams 94 or the lower arm beams 93 electrically connected to the leads of the flat cables 51; and (iii) the pair of the actuators 61 mounted on the respective housings 81 so as to be changeable in attitude between the open position for permitting insertion of the flat cables 51, and the close position suitable for pressing the inserted flat cables 51 against the upper arm beams 94 or the lower arm beams 93.

In addition to these, each of the actuators 61 has the operation parts 66 eccentrically formed in the body parts 65. The connector 60 has the cover member 75 covering above the middle parts of the terminals 91, and the cover member 75 is engaged to the stoppers 71.

With this construction, the second embodiment produces the effect of enhancing operability when both actuators 61 are in the close position, and the effect of preventing contact of the operator's finger and hand with the terminals 91, and adhesion of dust to the terminals 91, in addition to the same effect as in the first preferred embodiment.

It is to be understood that the present invention is not limited to the foregoing embodiments but various changes and modifications will occur based on the concept of the present invention, which may be considered as coming within the scope of the present invention as claimed in the appended claims.

What is claimed is:

1. A relay connector comprising:

a pair of housings, each having an insertion opening formed therein, through which a flat cable is inserted;

terminals that are commonly loaded into the housings, and provided with contact pieces electrically connected to conductive leads of the flat cable; and a pair of actuators secured to the housings so as to be changeable in an attitude thereof between a first position for permitting insertion of a flat cable and a second position capable of pressing the inserted flat cable against the contact pieces, wherein, the respective housings are connected to each other so that the insertion openings thereof are directed toward opposite directions; and the contact pieces are disposed on both sides of the terminals, respectively, and are connected to each other.

2. The relay connector according to claim 1, wherein the housings have the same structure, and the actuators have the same structure.

3. The relay connector according to claim 1, wherein the terminals are of bilaterally symmetrical configuration with respect to a line orthogonal to a longitudinal direction thereof.

4. The relay connector according to claim 1, wherein the housings are connected to each other by the terminals.

5. The relay connector according to claim 1, wherein the housings are connected to each other by the connecting members.

6. The relay connector according to claim 5, wherein each of the housings is provided with a projecting connecting member formed on a side opposite to the insertion opening, and a holding recess part for holding the connecting member, the connecting member and the holding recess part are disposed outside of a plurality of terminals in a direction of arrangement of the terminals arranged within the housings.

7. The relay connector according to claim 5, wherein each of the housings is provided with an engaging part formed on a side opposite to the insertion opening, the connecting member is provided with a connecting engagement part for being engaged with the engaging part, and the connecting member and the engaging part are disposed outside of a plurality of terminals in a direction of arrangement of the terminals arranged within the housings.

8. The relay connector according to claim 1, wherein the actuators are independently changeable in attitude thereof, each having a body part that is substantially parallel to a direction of insertion of the flat cable at the second position.

9. The relay connector according to claim 8, wherein each of the actuators has an operation part formed eccentrically in the body part.

10. The relay connector according to claim 5, further comprising a cover member that covers above middle parts of the terminals, the cover member being engaged with the connecting members.

* * * * *